US006992590B1

(12) United States Patent
Tietsworth et al.

(10) Patent No.: US 6,992,590 B1
(45) Date of Patent: Jan. 31, 2006

(54) SYSTEMS AND METHODS FOR SENSING A FLUID SUPPLY STATUS

(75) Inventors: Steven Tietsworth, San Diego, CA (US); Darin K Woolf, Oceanside, CA (US); Jonathan D Lucas, San Diego, CA (US); Igor Abramov, Encinitas, CA (US); David G. Fern, Santee, CA (US)

(73) Assignee: Xsilogy, Inc., San Diego, CA (US)

( * ) Notice: Subject to any disclaimer, the term of this patent is extended or adjusted under 35 U.S.C. 154(b) by 553 days.

(21) Appl. No.: 09/843,900

(22) Filed: Apr. 27, 2001

(51) Int. Cl.
*G08B 21/00* (2006.01)

(52) U.S. Cl. ..... 340/611; 340/539.22; 340/626

(58) Field of Classification Search ..... 340/605, 340/506, 626, 603, 609, 611, 539.22, 870.09, 340/539.26; 137/565.16, 565.33, 486; 426/231, 426/232; 141/94, 104, 286, 309; 22/1, 88
See application file for complete search history.

(56) References Cited

U.S. PATENT DOCUMENTS

| | | | | | |
|---|---|---|---|---|---|
| 2,896,656 | A | | 7/1959 | Allen et al. | 137/92 |
| 3,086,386 | A | | 4/1963 | Kapff | 73/23 |
| 3,839,914 | A | | 10/1974 | Modisette et al. | 73/438 |
| 3,952,577 | A | | 4/1976 | Hayes et al. | 73/55 |
| 4,088,987 | A | * | 5/1978 | Resler et al. | 340/605 |
| 4,118,973 | A | | 10/1978 | Tucker et al. | 73/55 |
| 4,384,472 | A | | 5/1983 | Tournier | 73/30 |
| 4,425,790 | A | | 1/1984 | Bice et al. | 73/55 |
| 4,578,990 | A | | 4/1986 | Abbott et al. | 73/55 |
| 4,607,342 | A | * | 8/1986 | Seiden et al. | 340/611 |
| 4,627,271 | A | | 12/1986 | Abbott et al. | 73/55 |
| 4,641,535 | A | | 2/1987 | Malguarnera | 73/861.01 |
| 4,644,781 | A | | 2/1987 | Mon | 73/55 |
| 4,662,219 | A | | 5/1987 | Nguyen | 73/195 |
| 4,750,351 | A | | 6/1988 | Ball | 73/55 |
| 4,860,594 | A | | 8/1989 | Hammond et al. | 73/861.42 |
| 4,876,882 | A | | 10/1989 | Yau | 73/55 |
| 4,901,563 | A | | 2/1990 | Pearson | 73/151 |
| 4,930,343 | A | | 6/1990 | Johnson | 73/196 |
| 4,961,349 | A | | 10/1990 | Tanis | 73/861.52 |
| 5,237,853 | A | | 8/1993 | Cassaday et al. | 73/32 A |
| 5,295,084 | A | | 3/1994 | Arunachalam et al. | 364/558 |
| 5,359,881 | A | | 11/1994 | Kalotay et al. | 73/54.06 |
| 5,360,139 | A | * | 11/1994 | Goode | 222/40 |
| 5,461,932 | A | | 10/1995 | Hall et al. | 73/861.61 |
| 5,481,260 | A | | 1/1996 | Buckler et al. | 340/870.09 |
| 5,537,860 | A | | 7/1996 | Haertl | 73/54.14 |
| 5,540,555 | A | * | 7/1996 | Corso et al. | 417/44.2 |
| 5,554,805 | A | | 9/1996 | Bahrton | 73/202 |
| 5,647,853 | A | | 7/1997 | Feldmann et al. | 604/155 |
| 5,661,232 | A | | 8/1997 | Van Cleve et al. | 73/54.05 |
| 5,808,559 | A | | 9/1998 | Buckler | 340/870.09 |
| 5,827,959 | A | * | 10/1998 | Clanin | 73/198 |
| 5,861,561 | A | | 1/1999 | Van Cleve et al. | 73/861.52 |
| 5,877,409 | A | | 3/1999 | Girling | 73/54.06 |
| 5,970,801 | A | | 10/1999 | Ciobanu et al. | 73/861.52 |
| 5,982,274 | A | | 11/1999 | Stelter et al. | 340/286.05 |
| 5,999,106 | A | | 12/1999 | Buckler | 340/870.09 |
| 6,029,527 | A | | 2/2000 | Seitz et al. | 73/861.52 |
| 6,062,066 | A | * | 5/2000 | Loen | 73/37 |
| 6,067,022 | A | | 5/2000 | Laswick et al. | 340/626 |
| 6,073,483 | A | | 6/2000 | Nitecki et al. | 73/54.05 |
| 6,142,582 | A | | 11/2000 | Karlsson | 303/113.2 |
| 6,152,327 | A | * | 11/2000 | Rhine et al. | 222/88 |
| 6,195,002 | B1 | | 2/2001 | Evans, Jr. et al. | 340/506 |
| 6,354,341 | B1 | * | 3/2002 | Saveliev et al. | 141/94 |
| 6,369,706 | B1 | * | 4/2002 | Anderson et al. | 340/506 |

* cited by examiner

*Primary Examiner*—Van Trieu
(74) *Attorney, Agent, or Firm*—Catalyst Law Group, APC; Thomas E. Jurgenson; Jeffrey E. Landes

(57) ABSTRACT

A system that includes a container containing a fluid, a fluid line coupled with the container, and a pump configured to pump the fluid out of the container through the fluid line. The system further includes a sensor that includes a wireless transmitter. The sensor is configured to sense the pressure in the fluid line and to periodically transmit, using the wireless transmitter, an alarm message when the pressure reaches an alarm threshold.

31 Claims, 7 Drawing Sheets

SYSTEMS AND METHODS FOR SENSING A FLUID SUPPLY STATUS

BACKGROUND OF THE INVENTION

1. Field of the Invention

The invention relates generally to fluid supply systems and more particularly to systems and methods for sensing a fluid supply status in a fluid supply system.

2. Background

Soda fountains are commonplace in many fast food or convenience store locations. A soda fountain usually dispenses several different types of soda, or more generally several different carbonated beverages, from several different dispensers. When a customer activates a particular dispenser, the carbonated beverage is mixed as it is being dispensed.

A carbonated beverage dispensed by a soda fountain is a mixture of a syrup and carbonated water, the syrup being specific to the particular carbonated beverage. The syrup is usually contained in a bag. A pump pumps the syrup out of the bag and through a syrup supply line up to the dispenser. Water is also pumped up to the dispenser through a water supply line. Injecting Carbon Dioxide (CO2) from a pressurized tank into the water supply line carbonates the water.

The pump that pumps the syrup is preferably a $CO_2$ pump and can, therefore, use CO2 from the same tank that is used to carbonate the water.

The mixing process is mostly automated and is controlled by the amount of syrup and carbonated water pumped up to the dispenser as the beverage is being dispensed; however, there is presently no way to detect when the syrup bag or pressurized $CO_2$ are about to run out. Therefore, there is no way to prevent the soda fountain from dispensing beverages with no syrup when the syrup bag runs out. When the CO2 runs, beverages will stop being dispensed altogether. This results in lost sales because the customer often decides not to purchase a beverage when they find that the soda fountain will not properly dispense their beverage of choice. Cumulative lost sales can be significant even if just a few sales are lost each time either the syrup or $CO_2$ runs out.

SUMMARY OF THE INVENTION

According to one aspect of the systems and methods for sensing a fluid status, a system comprises a container containing a fluid, a fluid line coupled with the container, and a pump configured to pump the fluid out of the container through the fluid line. The system further includes a sensor comprising a wireless transmitter. The sensor is configured to sense the pressure in the fluid line and to periodically transmit, using the wireless transmitter, an alarm message when the pressure reaches an alarm threshold.

In one example embodiment, a control unit that comprises a wireless receiver receives the message. The control unit is configured to receive the alarm message, using the wireless receiver, and to output an alarm indication in response to the alarm message.

In another example embodiment, the control unit is configured to determine when the container is empty based at least in part on the status information.

In another example embodiment, the control unit is further configured to determine when the container is replaced or refilled based at least in part on the status information.

In another example embodiment, the control unit is also configured to determine how long it took to replace or refill the container.

In still another embodiment, the control unit includes a network interface communicatively coupled to a communication network, and a transmitter configured to transmit the status information and/or information related to the status information through the network interface. In this case, the system can also include a data processing center communicatively coupled to the communication network. The data processing center can then be configured to determine when the container is empty based at least in part on the status information and/or information related to the status information and/or determine when the container is replaced or refilled based at least in part on the status information and/or information related to the status information as well as how long it took to replace or refill the container.

Other aspects, advantages, and novel features of the invention will become apparent from the following Detailed Description of Preferred Embodiments, when considered in conjunction with the accompanying drawings.

BRIEF DESCRIPTION OF THE DRAWINGS

Preferred embodiments of the present inventions taught herein are illustrated by way of example, and not by way of limitation, in the figures of the accompanying drawings, in which.

DETAILED DESCRIPTION OF THE PREFERRED EMBODIMENTS

Although the following discussion relates generally to soda fountains, it will be apparent that the systems and methods for sensing a fluid supply status have far broader application within the scope of the claims that follow this description. Therefore, to the extent that the description refers to a soda fountain, or to any particular fluid supply system, this is by way of example only. Such references should not be seen to limit the scope of the invention in any way.

Figure 1:
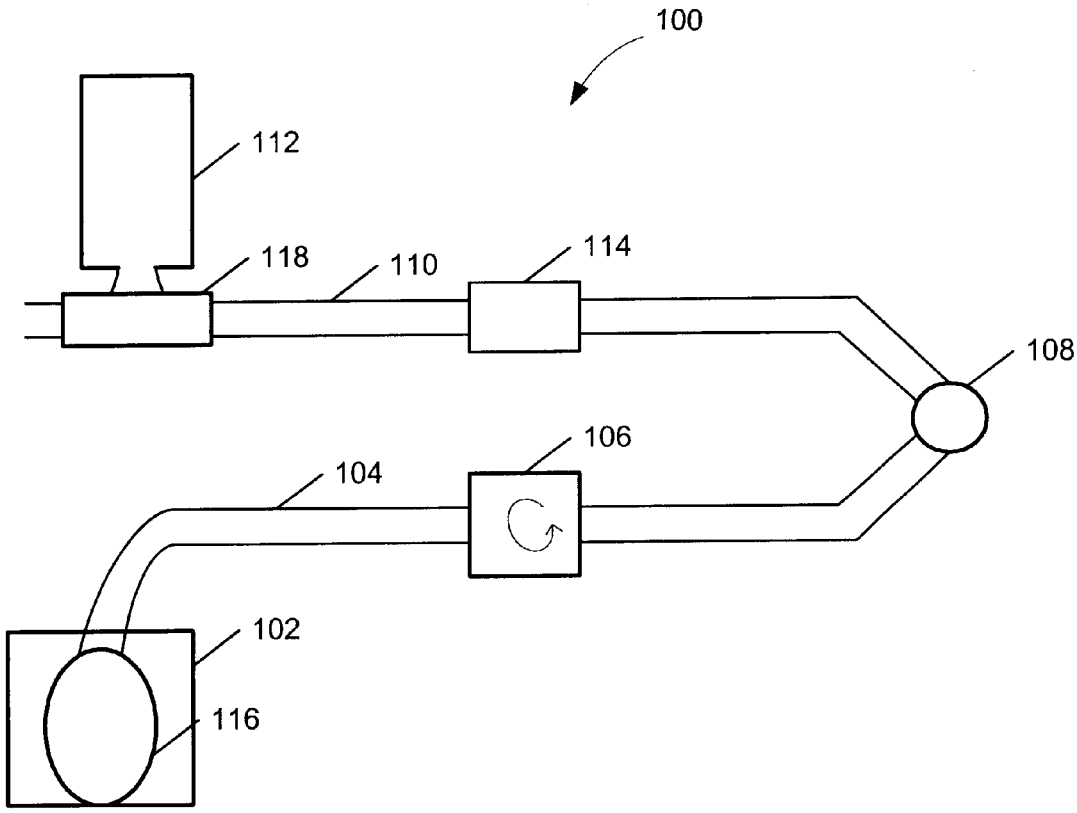
FIG. 1 is a logical block diagram of an exemplary fluid delivery system.

FIG. 1 is a logical block diagram of a system 100 that illustrates the functionality of a soda fountain. In system 100, syrup, or some other fluid, is contained in container 102. In this particular example, as in many soda fountains, container 102 comprises a bag 116, which actually contains the syrup. The syrup is pumped from container 102 through fluid line 104 by pump 106. Pump 106 pumps the syrup through line 104 up to dispenser 108. More generally, dispenser 108 can be viewed as mixer of some sort.

There are many different types of pumps that are appropriate for use in fluid dispensing or fluid supply systems. The selection of a particular pump must be based on the requirements of the particular system. Pumps operate by changing the pressure the fluid line, e.g., line 104, in a manner that causes the fluid, in this case syrup, to flow through the line. In system 100, the syrup in container 102 is subject to ambient pressure, i.e., 14.7 psi. Therefore, pump 106 actually needs to reduce the pressure in line 104 in order to draw the syrup out of container 102 and up to dispenser 108.

Flow control system 114 supplies water through water supply line 110 to dispenser 108. Flow control system 114 can, depending on the implementation, comprise a pump, a valve or valves, or a combination thereof. As water flows through line 110, carbonator 118 injects $CO_2$ from pressurized container or tank 112 into the water.

Unlike container 102, pressurized tank 112 is under a very high pressure, e.g., 2000 psi or more. As pressurized tank 112 empties, the pressure in pressurized tank 112 drops until it reaches a point where no more CO2 can be drawn or forced out of pressurized tank 112.

As mentioned above, there is presently no efficient way to detect when bag 116 or pressurized container 112 are empty. This problem is not one which only affects soda fountains. Any system that supplies a fluid from a container or any system supplying a pressurized gas can be affected similarly. For example, pressurized $CO_2$ is also a key component of beer dispensing systems, e.g., in bars. In fact there are many different types of pressurized gas systems that use, for example, propane or some other gas besides $CO_2$, in which it would be advantageous to be able to detect when the supply of pressurized gas has run out.

The systems and methods for sensing a fluid supply status address the problem by detecting the status of the fluids flowing in the system and reporting the status in a manner that can be used to generate alarm indications. The alarm indications allow for someone attending the system to correct the problem by refilling or replacing the fluid or pressurized gas supply.

Figure 2:
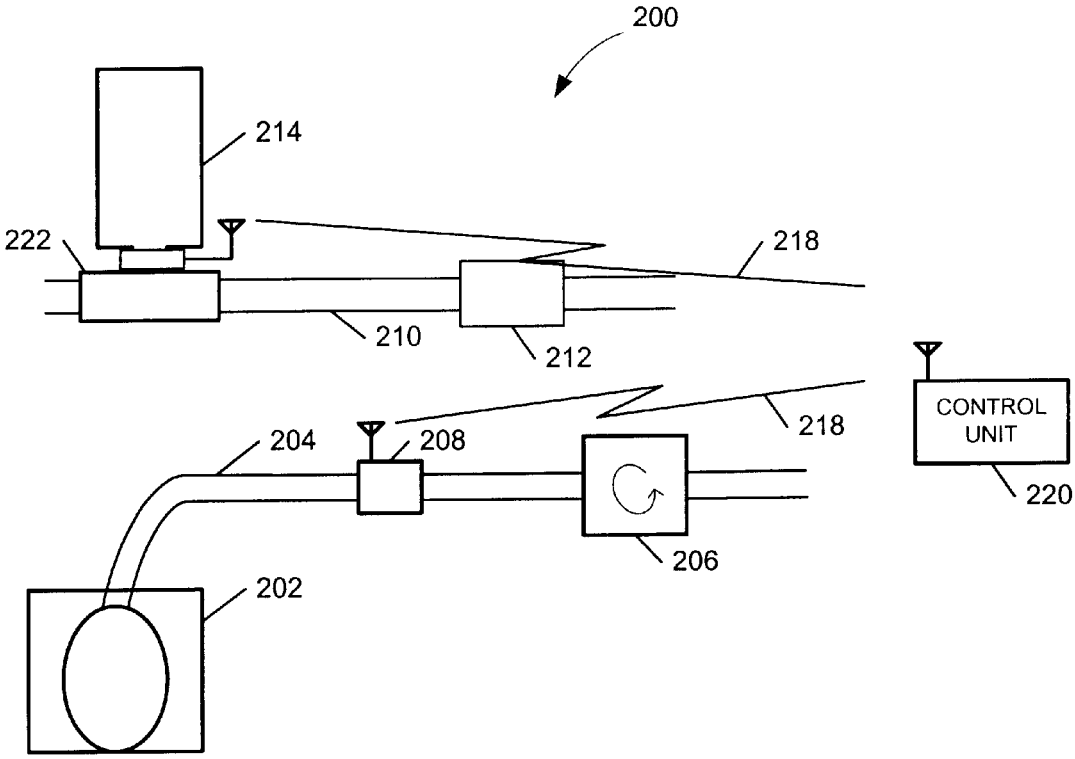
FIG. 2 is a logical block diagram of an example fluid delivery system in accordance with the invention.

FIG. 2 is a logical diagram of one example system 200 in accordance with the systems and methods for sensing a fluid supply status. As with system 100, system 200 comprises a container 202 that contains a fluid such as syrup for a carbonated beverage. The fluid is pumped out of container 202 by pump 206, which actually draws the fluid out by reducing the pressure in fluid line 204. Additionally, flow control system 212 controls the flow of water through water supply line 210. The water in water supply line 210 is carbonated by carbonator 222 using $CO_2$ from pressurized tank 214.

As mentioned, the systems and methods for sensing a fluid supply status are not limited to soda fountains. Therefore, supply lines 204 and 210 are not limited to supplying carbonated beverage syrup and carbonated water. Moreover, there can be a plurality of fluid supply lines. For example, there will actually be a separate syrup container 202 and supply line 204 for each different type of beverage in a soda fountain.

In order to detect when container 202 or pressurized container 214 is empty, system 200 integrates sensing devices 208 and 216 respectively. Preferably, these sensors sense the pressure at appropriate points within system 200 and relay this information over wireless communication links 218 to a control unit 220. Sensing devices 208 and 216 are unique with respect to each other and each must be select based on the requirements of the specific sensing application for which it is intended within system 200. Additionally, it will be apparent that certain aspects of the systems and methods described herein apply separately to fluid supply lines, such as line 204, and to supply lines that include in whole or in part pressurized gas, such as is the case with line 210. As such, the sensors and their application will be discussed separately below starting with sensing device 208.

As previously described, pump 206 supplies fluid from container 202 by reducing the pressure in line 204. A pump, such as pump 206, preferably cycles when in operation. Therefore, the pressure in line 204 actually oscillates up and down when fluid is being drawn out of container 202. Thus, for example, in a soda fountain application, the pressure in line 204 preferably oscillates between approximately 14 psi and 12 psi when pump 206 is pumping fluid out of container 202.

Pump 206 will continue to operate in this fashion until container 202 is empty. The coupling between container 202 and line 204 is preferably airtight; therefore, pump 206 will attempt to draw a vacuum, i.e., Øpsi, once container 202 is empty. This will result in a very sharp pressure drop in line 204.

Sensing device 208 is coupled to line 204 and is designed to sense the pressure within line 204. Sensing device 208 also includes a wireless transmitter for periodically transmitting messages related to the pressure in line 204 to a control unit 220. As long as the pressure in line 204 is within a normal operating range, sensing device 208 preferably sends such messages infrequently, e.g., every 2 hours or so. If, however, a sharp pressure drop is detected, sensing device 208 preferably begins to transmit messages much more frequently. Control unit 220 can then generate an alarm indication for whoever is attending to system 200.

It should be noted that sensing device 208 can be configured for a variety of pressure thresholds. In other words, sensing device 208 can generate an alarm when a variety of different pressure thresholds are reached with in line 204, not just when a large pressure drop is detected. In this manner, the systems and methods for sensing a fluid supply status are adaptable to a variety of systems besides soda fountains.

Figure 3:
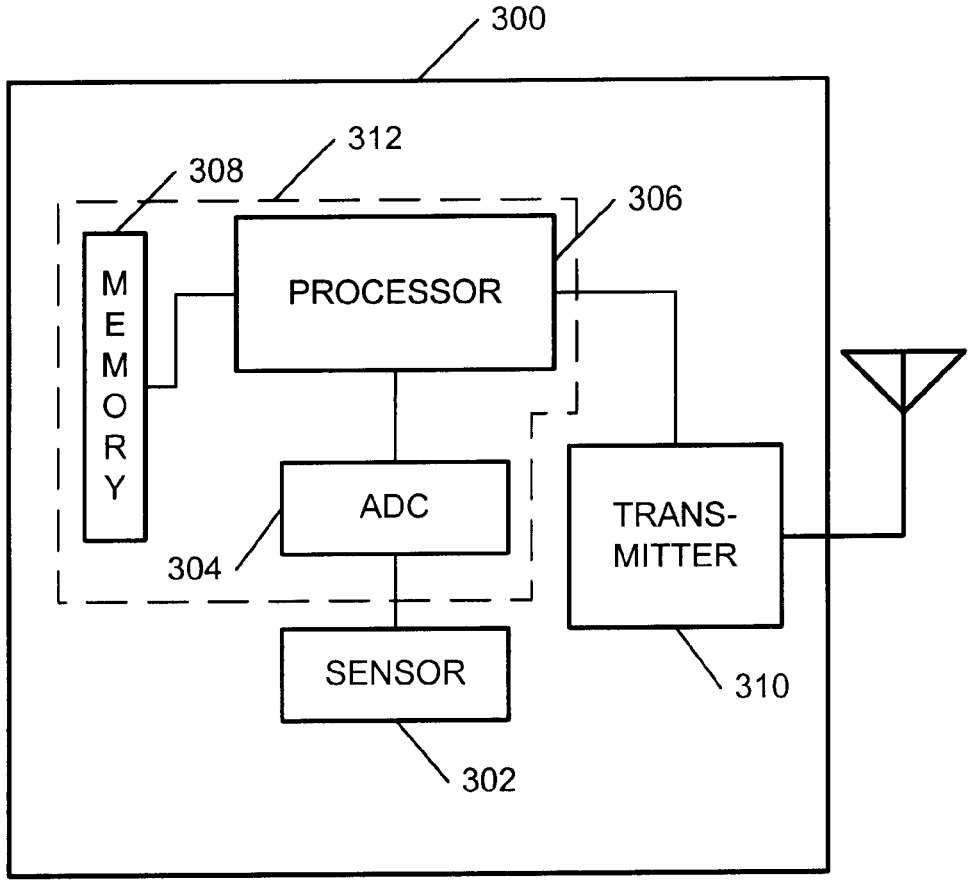
FIG. 3 is a logical block diagram of an example sensing device that can be used in the system of FIG. 2.

The content of the message sent from sensing device 208 to control unit 220 can vary depending on the complexity of sensing device 208 and/or control unit 220. FIG. 3 illustrates a logical block diagram of an example sensing device 300. Device 300 will be used to illustrate the varying complexity such a device can incorporate, and what effect the complexity can have on the information transmitted to control unit 220.

Sensing device 300 includes a pressure sensor 302. There are many different types of pressure sensors that can be incorporated into device 300; however the sensor must be selected in accordance with the requirements of a particular application. Therefore, the type of fluid container, type of fluid line, type of pump, type of fluid, accuracy required, etc., are all factors that can influence what type of pressure sensor is used.

Sensor 302 preferably translates pressure to an analog signal, which is input to Analog-to-Digital Converter (ADC) 304. ADC 304 converts the analog signal to a digital output.

Sensing device 300 also includes a transmitter 310 for transmitting information over a communication channel, such as channel 218. To control the operation of sensing device 300, a processor of some type is preferably included within device 300. Thus, in the simplest implementation, processor 306 can take the output of ADC 304 encode it appropriately and transmit it via transmitter 310. In more advanced applications, processor 306 can process the output and then transmit different messages based on the result of such processing. Processor 306 can even, in certain implementations, store the information related to the pressure sensed by sensor 302 in a memory 308. The stored information can then preferably be retreived later Processor 306 can be any type of processor appropriate for the functionality required by sensing device 300. Thus, processor 306 can be, for example, a microprocessor, microcontroller, Digital Signal Processor (DSP), or some combination thereof. Moreover, processor 306 may be included in an Application Specific Integrated Circuit (ASIC) that may also include ADC 304 and/or memory 308 as indicated by dashed line 312 in FIG. 3.

Memory 304 is preferably included in sensing device 300 even if processor 306 does not store information in memory 308. This is because memory 308 is needed to store the application code used by processor 306 to control the operation of sensing device 300. Certain application code used by sensing device 300 will be discussed more fully below.

Therefore, processor 306 can simply transmit raw data relating to the pressure sensed by sensor 302. Alternatively, processor 306 can process the raw data and select a message to transmit. For example, if processor 306 processes the raw data and determines that the pressure is within a normal operating range, then the processor can transmit a message indicating the flow status is normal. But if the processor processes the information and determines that the pressure has reached an alarm threshold, e.g. when a large pressure drop occurs in line 204, then the processor can transmit an alarm message.

Depending on the amount of processing and memory resources included in sensing device 300, processor 306 can transmit further information such as a time stamp, fluid line identifier, etc.

Figure 4:
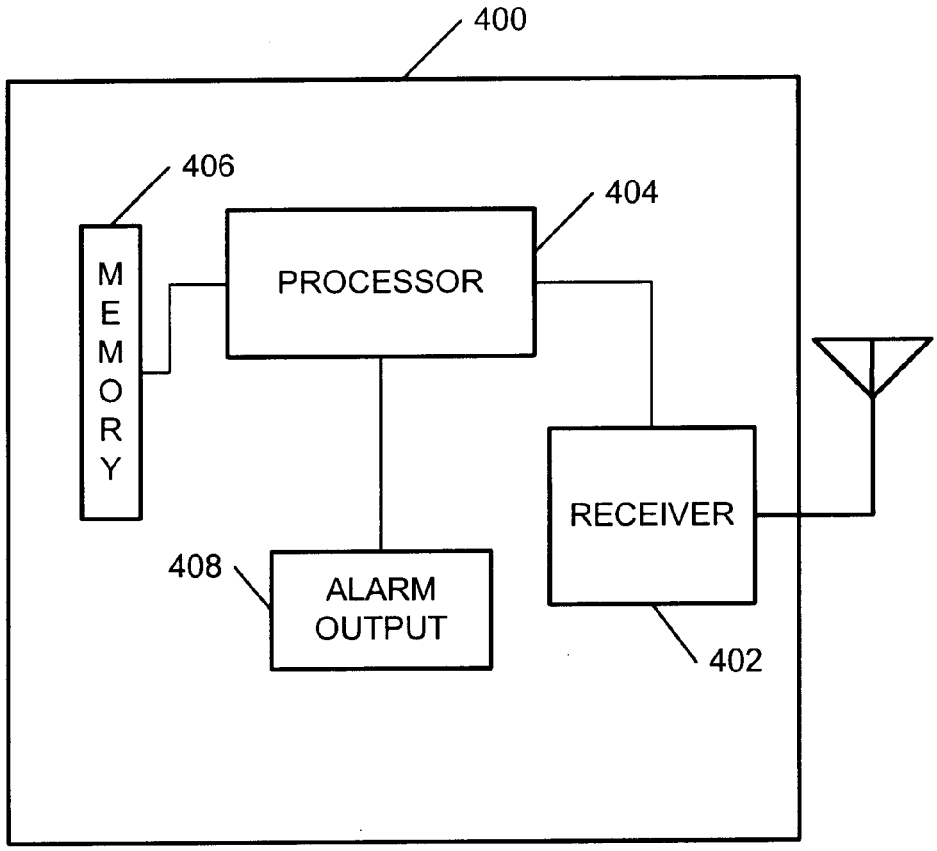
FIG. 4 is a logical block diagram of an example control unit that can be used in the system of FIG. 2.

The complexity of the message transmitted will have a direct impact on the complexity of device 300 and, therefore, on the cost of device 300. Thus, a tradeoff between complexity and cost is required. This tradeoff will also be impacted by the complexity and cost of the control unit. FIG. 4 is a logical block diagram of an example control unit 400, which can be used to illustrate the varying complexity that can be incorporated into such a unit.

Control unit 400 includes a receiver 402 configured to receive messages transmitted by a sensing device, such as sensing device 208, via a communication channel, such as channel 218. Processor 404 controls the operation of control unit 404 and receives the messages from receiver 402. Memory 406 stores application code used by processor 404 and can also, depending on the implementation, store the messages received by receiver 402 or data related thereto. Alarm output 408 is used to generate an alarm whenever the messages received by receiver 402 indicate that an alarm condition exists in a fluid line such as fluid line 204.

Control unit 400 can be a simple alarm unit or be much more complex. For example, if the messages received by receiver 402 are complex messages, e.g., the messages include a status, a fluid line identifier, etc., then unit 400 can be a simple alarm unit. In this case, processor 404 receives the message and outputs the appropriate alarm via alarm output 408.

Alarm output 408 can comprise a variety of output devices. For example, Alarm output 408 can comprise a simple LED panel. When unit 400 receives an alarm message indicating a fluid container associated with a certain fluid line is empty, then processor 404 can cause a LED corresponding to that fluid line to be turned on. An attendant, upon seeing that the LED is turned on, would know to change or refill the bag associated with that line. Once the bag was replaced or refilled, then unit 400 will start receiving messages indicating that the pressure status in that line is normal and the LED will be turned off.

Alternatively, alarm output 408 can comprise a display such as an LCD display. In this case, when the messages received by receiver 402 indicate an alarm condition for a certain fluid line, processor 404 can cause an appropriate message to be displayed on the display. For example, processor 404 can display a message indicating the alarm condition and the fluid line identifier. The attendant can then change or refill the associated fluid container. Processor 404 would then stop displaying the message, or possibly, display a message indicating that the pressure has returned to normal in the particular fluid line.

The attendant may not be near control unit 400 when an alarm message is received. Therefore, it is preferable, that alarm output 408 comprises an audio output such as a buzzer. When an alarm message is received, processor 404 can then activate the audio output and alert an attendant even if the attendant is not near control unit 400. An audio output can preferably be combined with a visual display, such as LEDs or an LCD. Further, If control unit 400 is a simple alarm unit, then it can even be portable so that it can be worn by the attendant. For example, control unit 400 could be a device similar to a pager. When there is an alarm condition the device can generate an audio output or vibrate and at the same time display a message indicating the fluid line that is the subject of the alarm.

If control unit 400 is a simple alarm unit, then it may or may not store information related to the messages received by receiver 402 in memory 406. The more messages that need to be stored, the more memory is required and the more expensive the unit becomes. Therefore, the amount of memory must be traded off against he cost of the unit. If the messages are stored in memory 406, then preferably they can be retrieved at a later time.

On the other hand, Control unit 400 can be much more complex. For example, if the messages received by receiver 402 only comprise raw sensor data, then processor 404 is required to process the data and determine what action to take. Processor 404 can even be configured to track the status of each fluid line in the system and to store the status in memory 406 for later retrieval. Moreover, processor 404 can be configured to store information related to the messages, such as the time of the message, the associated fluid line identifier, etc. From this information, processor 404 can be configured to determine related information, such as how long it took the attendant to replace or refill the container. This type of related information can be very valuable to the store operator, because it can be used to identify areas that need improvement, or more attention, in relation to a particular fluid delivery system.

Control unit 400 can even be part off a larger sensor network. For example, a convenience store location may include sensors sensing fluid lines in one or more soda fountains as well as sensors for sensing temperatures in refrigeration compartments and/or other types of sensors, with all of the sensors wirelessly reporting data back to control unit 400.

Figure 5:
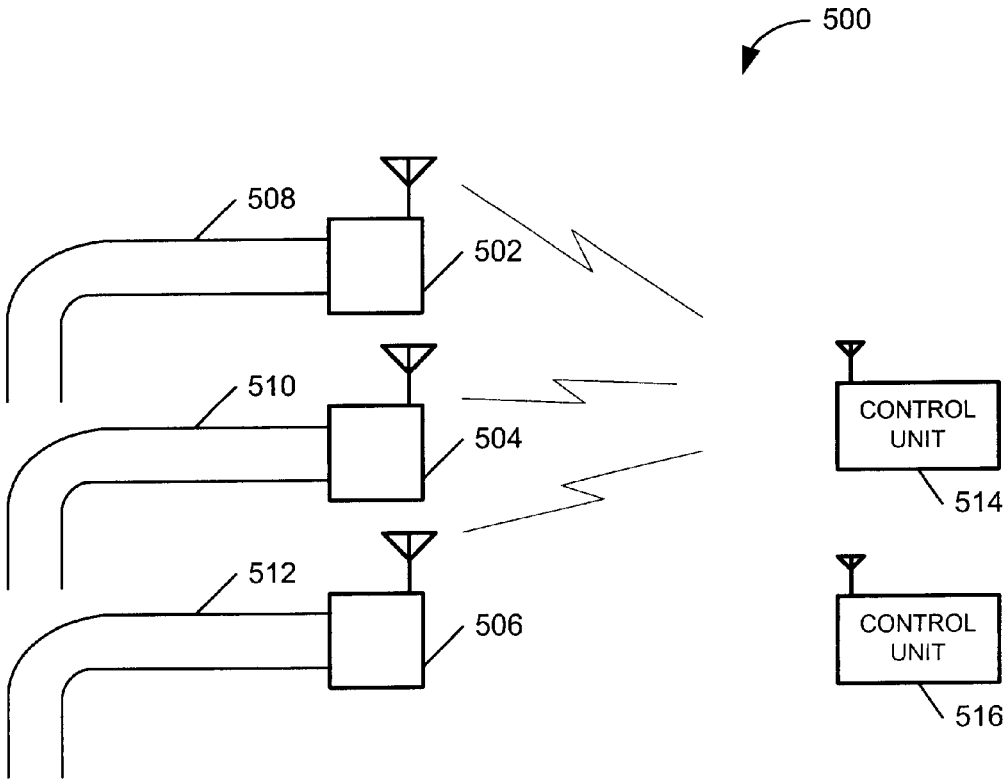
FIG. 5 is a logical block diagram of another example fluid delivery system in accordance with the invention.

Further, in certain implementations there may be more than one control unit. For example, FIG. 5 is a logical block diagram of a system 500 that comprises two control units 514 and 516 in communication with sensing devices 502, 504, and 506, which monitor fluid lines 508, 510, and 512 respectively. Preferably, control unit 514 is a simple alarm unit as described above and, therefore, may be stationary or portable. Control unit 516, on the other hand, is preferably much more complex and is configured to store and track the status messages transmitted by sensing devices 502, 504, and 506.

Therefore, in one implementation, sensing devices 502, 504, and 506, transmit status messages to both control units 514 and 516. The messages, therefore, must have enough information to allow control unit 514 to generate the appropriate alarm identifying the appropriate fluid line. The more information included in the messages, however, the more complex, and more expensive, sensing devices 502, 504, and 506 become.

If less complex sensing devices are required, then system 500 can be configured such that sensing devices 502, 504, and 506 only transmit to control unit 516. Control unit 516 processes the messages and determines what action to take. Control unit 506 can then transmit a more complex message to control unit 514 containing the requisite information to allow control unit 514 to generate the appropriate alarm indication. This type of implementation of course requires that control unit 516 include a full wireless transceiver as opposed to just a receiver as described above.

The wireless communication channels 218 in FIG. 2 are part of a wireless Local Area Network (LAN) included in system 200. There are several wireless LAN protocols that define the encoding and channel access protocols to be used by devices, such as sensing device 208 and control unit 220, when communicating with each other. For example, some common wireless LAN protocols are IEEE802.11, HomeRF™, and Bluetooth™, to name a few. Alternatively, a customized protocol can be defined that is specific to the particular implementation. The advantage of a customized protocol is that the overhead associated with the protocol can be reduced by only including functionality required for the particular system. This can be important since the application code that allows processor 306 and 404, for example, to implement the protocol must be stored in memory, such as memories 308 and 406. Thus, a reduced overhead protocol can be advantageous.

Figure 6:
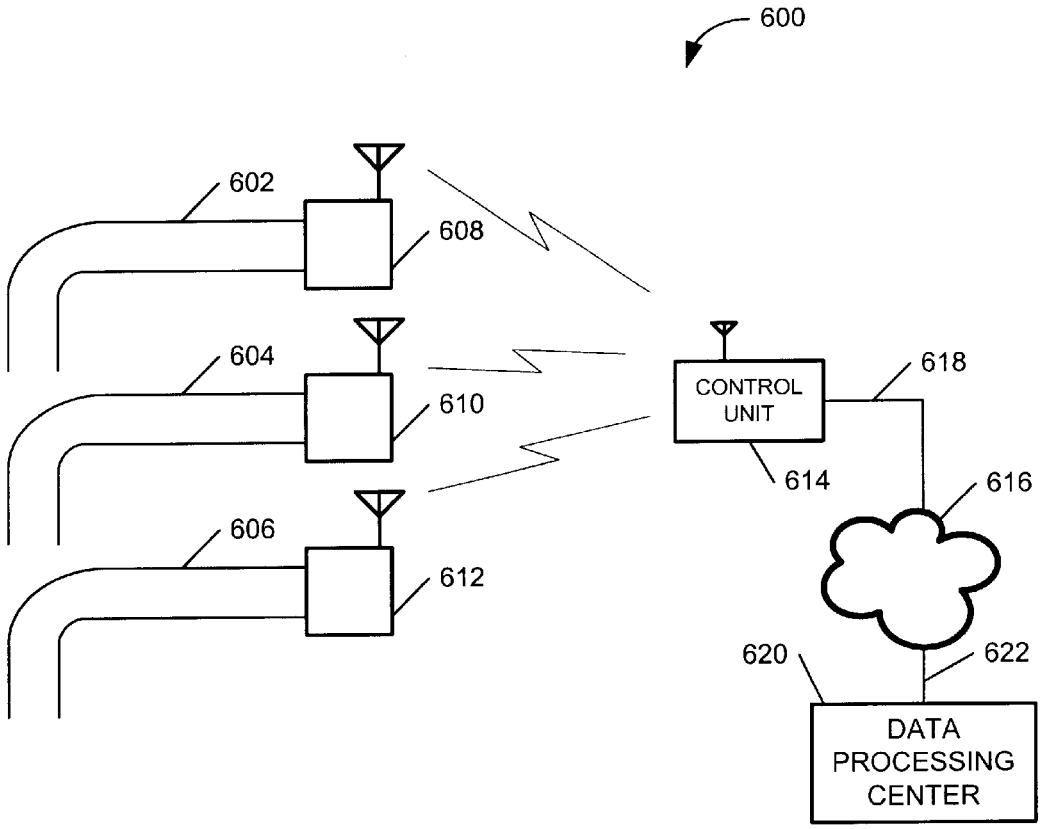
FIG. 6 is a logical block diagram of still another example fluid delivery system in accordance with the invention.

FIG. 6 is a logical block diagram illustrating a system 600 in which control unit 614 includes a network interface 618 allowing control unit 614 to communicate with a remote data processing center 620 via a communication network 616. Preferably, network interface 618 is a wired connection to a Wide Area Network (WAN) or a Local Area Network (LAN). Although, network connection 618 can be, for example, a wireless interface to a wireless WAN 616. Data processing center 620 is wired or wirelessly connected to network 616 through network interface 622.

Data process center 620 can be configured to retrieve information related to the status of fluid lines 608, 610, and/or 612 that is stored in control unit 614 or in sensing devices 602, 604, and/or 612. Alternatively, the information can be forwarded directly to data processing center 620 without first being stored. Data processing center can then be responsible for tracking and storing the status information and can be configured to determine related information, such as how long it took the attendant to replace or refill the container, as described above.

In certain implementations, control unit 614 can be configured to immediately forward messages received from sensing devices 602, 604, and 606 to data processing center 620. Data processing center 620 can then be configured to determine what action to take in response to the messages and instruct control unit 614 accordingly. For example, if an alarm condition exists, data processing center 620 can instruct control unit 614 to output an alarm indication. If a simple alarm unit is also included in system 600 as described above, then data processing center 620 can instruct control unit 614 to instruct the alarm unit to generate the alarm indication.

The discussion to this point has focused on fluid lines such as fluid line 204 in FIG. 2. As noted, however, there can also be pressurized gas containers, such as container 214 that need to be monitored to ensure they do not run out. In the systems and methods for sensing a fluid supply status, sensing devices, such as device 216, can be included to monitor the pressure in container 214. In a soda fountain, there is typically one pressurized gas container; however, there are many systems that include pressurized gas supplies to which the systems and methods about to be described will apply.

Sensing device 216 monitors the pressure in container 214 and periodically transmits messages to control unit 220 in much the same manner as described above. Sensing device 216 can be very similar to device 300 described in relation to FIG. 3, but the sensor 302 used for device 216 will be unique relative to the sensor use for sensing device 208, for example. Sensor 302 used in conjunction with a sensing device for pressurized gas containers, such as device 214, must be selected according to the particular application. Thus, the type of container, the pressure the container is under, the type of gas, etc., are all factors that must be considered when selecting sensor 302 for use in a device, such as device 216.

Unlike the pressure in line 204, which oscillates within a normal operation range and then drops when container 202 is empty, the pressure in container 214 steadily drops as beverages are dispensed and $CO_2$ is consumed. Thus, sensing device 214 can periodically transmit messages with information related to the pressure in container 214. As described above, this information can comprise simple raw data, or more complex information, such as a container identifier, pressure reading, etc. Control unit 220 receive the messages and predicts when container 214 will run out of gas. Based on this prediction, control unit 220 preferably generates an alarm indication to an attendant prior to the container running out.

In a soda fountain, the pressure in container 214 will not drop linearly, but will be influenced by the rate at which beverages are dispensed. In this case, the prediction made by unit 220 must be constantly updated and preferably takes into account patterns of consumption. When a system, such as system 200, is first installed, however, control unit 220 will not have any data relating to rates of consumption for the system. In this case, control unit 220 preferably uses data from other similar locations/systems as an initial calibration from which to generate, in conjunction with the messages form device 216, predictions of when container 214 will run out. This calibration data can then preferably be adaptively updated as data relating to system 200 is generated.

As described above, control unit 220 can include an alarm output for generating the alarm indication or it can be interfaced to a fixed or portable alarm unit, the sole function of which is preferably to generate the alarm indication. Additionally, the prediction, as well as any storage or tracking of data that is required, can be handled by a remote data processing center to which control unit 220 is interfaced via a network interface as described above.

It should also be noted that the systems and methods for sensing a fluid status are not necessarily restricted to sensing the pressure of pressurized gas containers. The systems and methods described herein are equally adaptable to containers or fluid supply systems involving pressurized liquids or other types of substances such as powders or foams.

Figure 7:
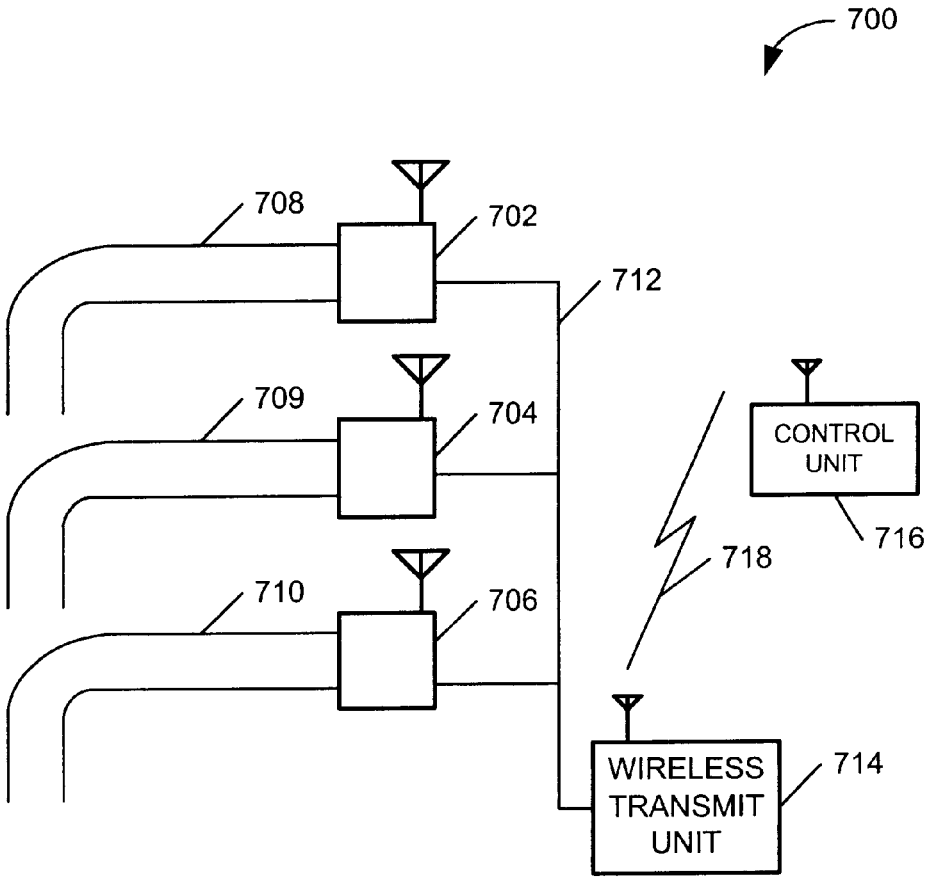
FIG. 7 is a logical block diagram of still another example fluid delivery system in accordance with the invention.

It should be noted that including a wireless transmitter in a sensing device, such as device 208 or 216 in FIG. 2, can increase the cost and complexity of the sensing devices beyond an acceptable point. FIG. 7 is a logical block diagram of an example system 700 that is designed to combat this problem. System 700 includes sensing devices 702, 704, and 706, which are coupled to, and configured to sense the pressure in, fluid lines 708, 710, and 712 respectively. In this regard, sensing devices 702, 704, and 706 are similar to sensing device 208. But as will be apparent the systems and methods about to be described are equally applicable to systems that include sensing devices configured to sense the pressure in pressurized containers, such as container 214.

Sensing devices 702, 704, and 706 do not include wireless transmitters. Instead, they are coupled to a wireless transmit unit 714 via a LAN or other wired network 712. Wireless communication unit 714 takes messages generated by devices 702, 704, or 706, encodes them in accordance with the protocol used for wireless communication within system 700 and transmits the messages to control unit 716 over wireless communication channel 718. In this manner, the systems and methods for sensing a fluid supply status as described above can be adapted to systems that require less expensive sensing devices.

While embodiments and implementations of the invention have been shown and described, it should be apparent that many more embodiments and implementations are within the scope of the invention. Accordingly, the invention is not to be restricted, except in light of the claims and their equivalents.

What is claimed is:

1. A system, comprising:

a container containing a fluid;

a fluid line coupled with the container;

a pump configured to pump the fluid out of the container through the fluid line;

a sensor comprising a wireless transmitter, the sensor configured to sense a pressure in the fluid line and to periodically transmit, using the wireless transmitter, an alarm message when the pressure reaches an alarm threshold; and a control unit comprising a wireless receiver, the control unit configured to receive the alarm message, using the wireless receiver, and to output an alarm indication in response to the alarm message.

2. The system of claim 1, wherein the control unit further comprises a display, and wherein the alarm indication comprises at least in part displaying a message on the display.

3. The system of claim 1, wherein the control unit further comprises a visual indicator, and wherein the alarm indication comprises at least in part activating the visual indicator.

4. The system of claim 3, wherein the visual indicator is an LED or a LCD.

5. The system of claim 1, wherein the control unit further comprises an audio output, and wherein the alarm indication comprises at least in part activating the audio output.

6. The system of claim 5, wherein the control unit is portable.

7. The system of claim 1, wherein the pump pumps the fluid out of the container by reducing the pressure in the fluid line, and wherein the sensor transmits the alarm message when the pressure drops below the alarm threshold.

8. The system of claim 1, wherein the sensor is configured to stop transmitting the alarm message when the pressure returns to a normal operation range.

9. A system, comprising:

a container containing a fluid;

a fluid line coupled with the container;

a pump configured to pump the fluid out of the container through the fluid line;

a sensor comprising a wireless transmitter, the sensor configured to sense a pressure in the fluid line and to periodically transmit status information relating to the pressure in the fluid line using the wireless transmitter; and a control unit comprising a wireless receiver, the control unit configured to:

receive the status information using the wireless receiver;

determine when the container is empty based at least in part on the status information; and determine when the container is replaced or refilled based at least in part on the status information.

10. The system of claim 9, wherein the control unit is also configured to determine how long it took to replace or refill the container.

11. The system of claim 9, wherein the control unit further comprises:

a network interface communicatively coupled to a communication network; and a transmitter configured to transmit the status information and/or information related to the status information through the network interface.

12. The system of claim 11, further comprising a data processing center interfaced to the communication network, the data processing center configured to receive and process the status information and/or the information related to the status information.

13. The system of claim 9, wherein the sensor is configured to periodically transmit a status message when the pressure in the fluid line is in a normal operation range.

14. The system of claim 9, wherein the sensor is configured to periodically transmit an alarm message when the pressure in the fluid line reaches an alarm threshold.

15. The system of claim 14, wherein the control unit further comprises an alarm output, and wherein the control unit is configured to generate an alarm indication when the control unit receives an alarm message from the sensor.

16. A system, comprising:

a container containing a fluid;

a fluid line coupled with the container;

a pump configured to pump the fluid out of the container through the fluid line;

a sensor comprising a wireless transmitter, the sensor configured to sense a pressure in the fluid line and to periodically transmit status information relating to the pressure in the fluid line using the wireless transmitter; and a control unit comprising:

a wireless receiver, the control unit configured to receive the status information using the wireless receiver;

a network interface communicatively coupled to a communication network; and a transmitter configured to transmit the status information and/or information related to the status information through the network interface; and a data processing center communicatively coupled to the communication network, the data processing center configured to:

determine when the container is empty based at least in part on the status information and/or information related to the status information;

determine when the container is replaced or refilled based at least in part on the status information and/or information related to the status information; and determine how long it took to replace or refill the container.

17. The system of claim 16, wherein the data processing center is configured to store and/or track the status information and/or information related to when the container is empty, when the container is replaced or refilled, and how long it took to replace or refill the container.

18. The system of claim 17, wherein the data processing center is configured to generate a report based on the stored and/or tracked information.

19. A method of monitoring the status of fluid in a container, comprising:

pumping the fluid out of the container through a fluid line;

sensing the pressure in the fluid line;

transmitting an alarm message indicating that the container is empty when the pressure in the fluid line reaches an alarm threshold;

transmitting a message when the pressure returns to a normal operation range indicating the container has been replaced or refilled.

20. The method of claim 19, further comprising determining how long it took to replace or refill the container.

21. A system, comprising:

a means for containing a fluid;

a fluid line coupled with the means for containing a fluid;

a pressure reducing means for reducing the pressure in the fluid line and causing the fluid to be pumped out of the means for containing the fluid through the fluid line;

a sensing means, including a wireless transmitting means, for sensing a pressure in the fluid line and periodically transmitting, using the wireless transmitting means, status information relating to the pressure in the fluid line; and a controlling means, including a wireless receiving means, for receiving the status information, using the wireless receiving means, and to output an alarm indication when the status information indicates that the pressure in the fluid line has reached an alarm threshold.

22. The system of claim 21, wherein the controlling means is further used for:

determining when the means for containing the fluid is empty based at least in part on the status information; and determine when the means for containing the fluid is replaced or refilled based at least in part on the status information.

23. The system of claim 22, wherein the controlling means is further used for determining how long it took to replace or refill the means for containing the fluid.

24. The system of claim 21, wherein the controlling means further comprises:

a network interface communicatively coupled to a communication network; and a transmitting means configured to transmit the status information and/or information related to the status information through the network interface;

and wherein the system further comprises a data processing means communicatively coupled to the communication network, the data processing means used for:

determining when the means for containing the fluid is empty based at least in part on the status information and/or information related to the status information;

determining when the means for containing the fluid is replaced or refilled based at least in part on the status information and/or information related to the status information; and determining how long it took to replace or refill the means for containing the fluid.

25. A soda fountain, comprising:

a syrup bag containing a syrup used to make a beverage;

a syrup line coupled with the syrup bag;

a pump configured to pump the syrup out of the syrup bag through the syrup line;

a sensor comprising a wireless transmitter, the sensor configured to sense a pressure in the syrup line and to periodically transmit, using the wireless transmitter, an alarm message when the pressure drops below an alarm threshold indicating that the syrup bag is empty; and a control unit comprising a wireless receiver, the control unit configured to receive the alarm message, using the wireless receiver, and to output an alarm indication in response to the alarm message.

26. The system of claim 25, wherein the sensor is configured to stop transmitting the alarm message when the pressure rises to a normal operation range indicating the syrup bag has been replaced or refilled.

27. A system, comprising:

a plurality of containers each containing a fluid;

a plurality of fluid lines, each of the plurality of fluid lines coupled to one of the plurality of containers;

a plurality of pumps, each of the plurality of pumps coupled with one of the fluid lines and configured to pump the fluid out of the container through the associated fluid lines;

a plurality of sensors each comprising a communication interface configured to couple the sensor to a communication network, each of the plurality of sensors configured to;

couple with one of the plurality of fluid lines;

sense a pressure in the fluid line; and communicate information related to the pressure in the fluid line through the communication interface;

a wireless transmit unit comprising a wireless transmitter and a communication interface configured to interface the wireless transmit unit to the communication network, the wireless transmit unit configured to receive the information related to the pressure in the fluid lines from the plurality of sensors and to transmit the received information via the wireless transmitter; and a control unit comprising a wireless receiver, the control unit configured to receive, using the wireless receiver, the information related to the pressure in the fluid lines transmitted by the wireless transmit unit.

28. The system of claim 27, wherein the control unit is configured to determine when a particular container is empty based at least in part on the information received from the wireless transmit unit; and generate an alarm indication indicating which container is empty.

29. The system of claim 28, wherein the control unit is configured to determine when the container indicated in the alarm indication is replaced or refilled based at least in part on information received from the wireless transmit unit.

30. The system of claim 27, wherein the control unit further comprises:

a network interface communicatively coupled to a communication network; and a transmitter configured to transmit the information received from the wireless transmit unit through the network interface.

31. The system of claim 30, further comprising a data processing center interfaced to the communication network, the data processing center configured to receive and process the information transmitted through the network interface by the control unit.

* * * * *